United States Patent [19]

Bortolani

[11] 4,410,089

[45] Oct. 18, 1983

[54] FLEXIBLE PACKAGE, AND METHOD AND APPARATUS FOR MANUFACTURING SAME

[75] Inventor: Ermanno Bortolani, Milan, Italy

[73] Assignee: W. R. Grace & Co., Cryovac Division, Duncan, S.C.

[21] Appl. No.: 313,511

[22] Filed: Oct. 21, 1981

[30] Foreign Application Priority Data

Nov. 11, 1980 [GB] United Kingdom ..... 8036190

[51] Int. Cl.[3] ..... B65B 61/18; B65D 73/00

[52] U.S. Cl. ..... 206/633; 53/133; 53/412; 83/697; 206/461; 493/79; 493/80; 493/418; 493/450

[58] Field of Search ..... 206/461, 484, 484.2, 206/632, 633; 53/133, 412, 509; 493/87, 963, 80, 79, 418, 450; 83/694, 697

[56] References Cited

U.S. PATENT DOCUMENTS

| | | | |
|---|---|---|---|
| 2,778,176 | 1/1957 | Haase | 53/133 |
| 2,976,658 | 3/1961 | Kostur | 53/509 |
| 4,196,809 | 4/1980 | Tonrey | 206/484 |

FOREIGN PATENT DOCUMENTS

| | | | |
|---|---|---|---|
| 646980 | 8/1962 | Canada | 206/633 |

*Primary Examiner*—George E. Lowrance
*Assistant Examiner*—Jimmy G. Foster
*Attorney, Agent, or Firm*—John J. Toney; William D. Lee, Jr.; Joseph P. Harps

[57] ABSTRACT

An easy-open pack is formed by (a) pre-cutting a corner of a film panel which, in the finished pack, forms one panel to be sealed against another panel around the periphery of a product article to close the pack, and (b) carrying out the sealing operation while holding the tab formed by said pre-cut corner displaced away from contact with the other film panel, preferably by folding the tab back on itself, more preferably while tack sealing it in said folded configuration.

25 Claims, 18 Drawing Figures

Fig. 4.
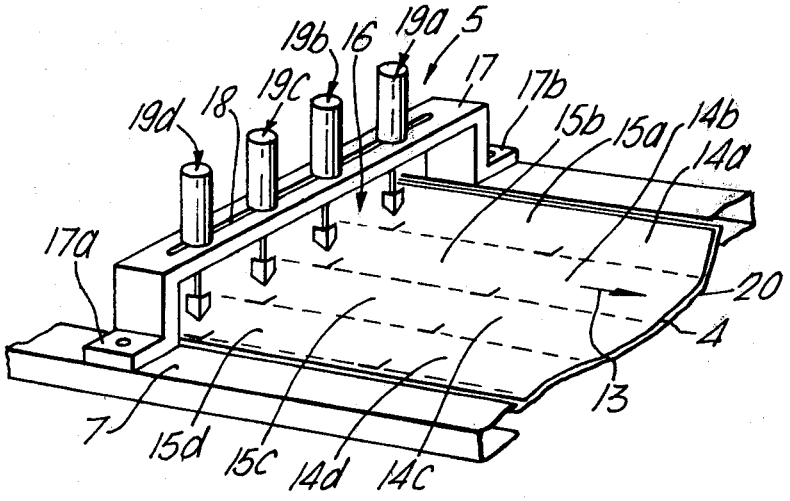
Fig. 5.
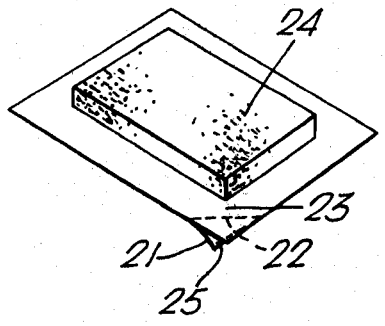
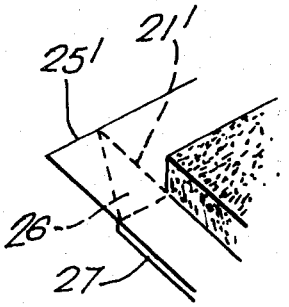
Fig. 6.

FLEXIBLE PACKAGE, AND METHOD AND APPARATUS FOR MANUFACTURING SAME

DESCRIPTION

The present invention relates to a package of flexible plastics material, preferably a vacuum skin package. In particular the invention relates to a package which can readily be opened by the consumer in that parts of the package at or near a seal region are left unadhered so as to provide a start for ripping open of the pack by the consumer. Such a package is referred to herein as an easy-open pack. The invention also provides a method of and apparatus for manufacturing an easy-open pack.

British Patent Specification No. 1,360,808 discloses an easy-open pack formed of superposed, sealed layers of thermoplastic material with a corner of the package rendered easily openable by virtue of a paper insert between the thermoplastic sheets in order to prevent localised sealing at the corner, thereby providing a start for the consumer to peel the two thermoplastic sheets one from another.

British Patent Specification No. 1,510,115 also discloses an easy-open pack in which the corner of the pack is rendered easily openable by virtue of a patch of ink arising at the corner of the pack, again in order to prevent the two thermoplastic sheets from bonding to one another when subjected to the application of heat and pressure in the normal sealing process.

U.S. Pat. No. 3,552,638 discloses an easy-open pack in which the opening action facilitated by the presence of an unsealed zone at the seal region involves delamination of one of the film laminates at the seal region.

Even with these known processes, it is often difficult to start the peeling operation because even at the unadhered zone the two layers tend to conform with one another at the corner of the pack and consequently it is not always easy for the consumer to be able to start the separation of the two thermoplastic layers at the corner.

It is therefore an object of the present invention to provide an easy-open pack in which the above disadvantage is eliminated, and also to provide a method of and an apparatus for manufacturing such an improved pack.

One aspect of the present invention provides a pack for a product enclosed therein comprising at least two superimposed film portions sealed together at a seal region and wherein at least one of said film portions is provided with an unadhered zone caused by a curled displacement of one said film portion at said unadhered zone before sealing.

The invention also provides a pack comprising a product enclosed within a flexible enclosure of a plastics film and sealed at a seal region by the adhesion together of two superposed film portions, one of said film portions at a marginal zone at or near said seal region being displaced away from a position of contact with the other of said film portions, thereby avoiding adhesion at said zone without the need for masking one or both of the film portions to prevent sealing of the film portions at said zone.

A further aspect of the present invention provides a process for forming an easy-open pack, comprising: providing a pack closable by adhering superposed film portions of said pack at a seal region; displacing one of said film portions in a given zone, at or near said seal region, away from a position where it will contact the other said film portion at said zone; and sealing together said film portions at the remainder of said seal region away from said zone.

A fourth aspect of the invention provides apparatus for forming an easy-open pack, comprising means for supporting a first film portion, means for displacing said first film portion at a zone thereof at or adjacent an intended seal area of the finished pack, means for sealing said first film portion to a further film portion, and means for preventing said displaced region of said first film portion from contacting said further film portion at said zone during sealing.

The invention also provides apparatus for forming an easy-open pack, comprising means for supporting a first film portion before attachment of a second film portion thereto in face-to-face contact, means for forming a non-rectilinear cut in said one film portion, means for displacing a zone of the said first film portion at said non-rectilinear cut-away from the position it held before cutting, means for folding said displaced film portion back into contact with said one film layer adjacent said zone, and means for sealing said one film portion to said second film portion while said displaced zone of said first film portion is so folded.

In order that the present invention may more readily be understood, the following description is given, merely by way of example, with reference to the accompanying drawings in which:

FIG. 4 is a perspective view of the apparatus, illustrating generally the formation and the orientation of the easy-open feature during an intermediate stage of production of a pack in accordance with the present invention;

FIG. 5 is a perspective view of an easy-open pack in accordance with the present invention;

FIG. 6 is a perspective detail of a further embodiment of the pack in accordance with the present invention;

Figure 10:
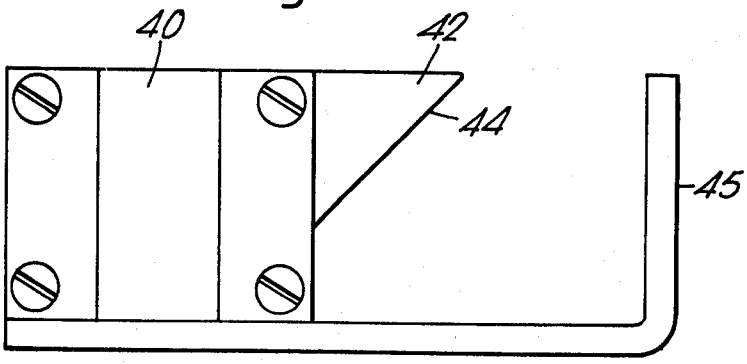
FIG. 10 is a top plan view of the tucking anvil shown in FIGS. 7 and 8.
Figure 11A:
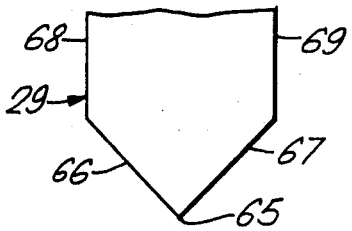
Figure 11B:
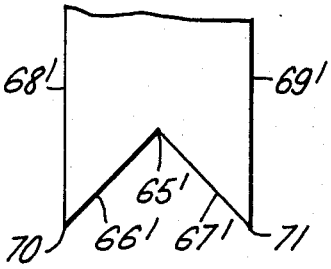
Figure 14A:
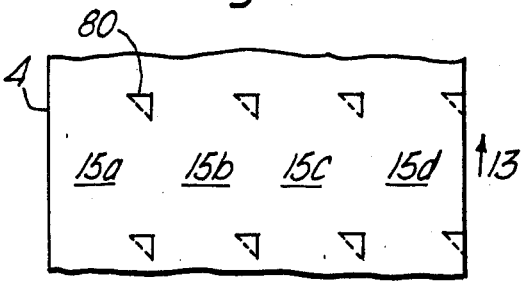
Figure 12:
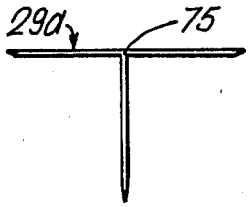
Figure 14B:
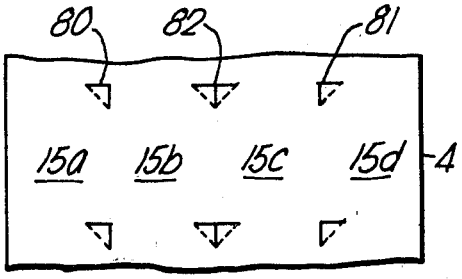
Figure 13A:
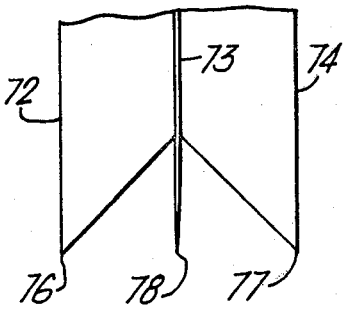
Figure 14C:
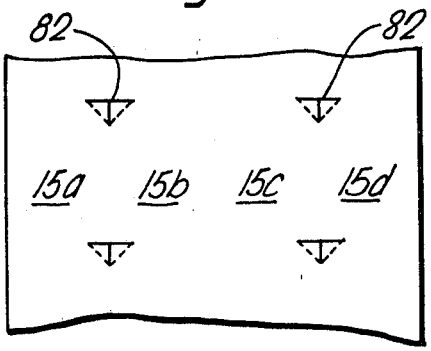
Figure 13B:
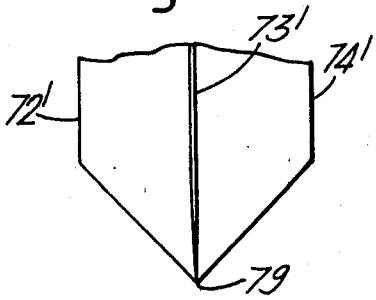

FIG. 11*a* is a side elevational view of one form of cutting blade which will have the cross-sectional view shown in FIG. 10;

FIG. 11*b* is an elevational view of an alternative form of cutting blade which will have the same cross-sectional view as shown in FIG. 10, and will therefore form a single L-shaped cut;

FIG. 12 is a transverse sectional view of an alternative form of cutting blade which will form a T-shaped cut for simultaneously forming the easy-open corner features of two adjacent packs;

FIG. 13*a* is an elevational view of one form of cutting blade which will have the cross-sectional view shown in FIG. 12;

FIG. 13*b* is an elevational view of an alternative form of cutting blade which will have the same cross-sectional view shown in FIG. 12; and FIGS. 14*a*, 14*b*, and 14*c* illustrate various different configurations of the arrangements of the cuts to form simultaneously the easy-open corner features of rows of four packs disposed across a continuous travelling web.

Figure 1:
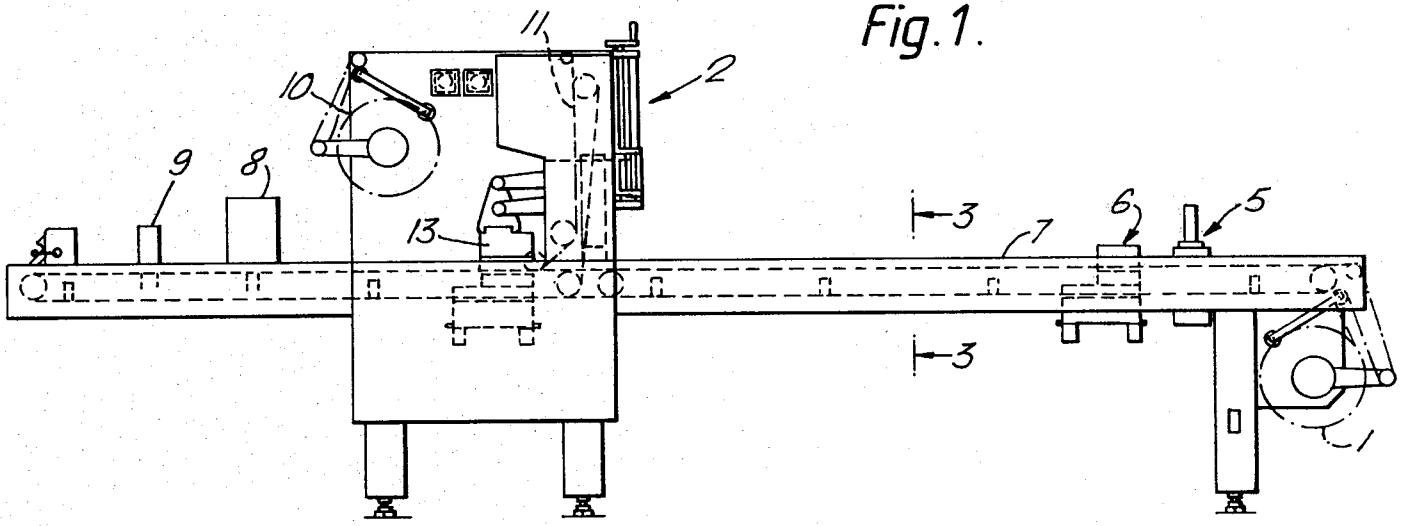
FIG. 1 is a side elevational view, on a small scale, of a packaging apparatus in which easy-open packs in accordance with the present invention can be formed.
Figure 2:
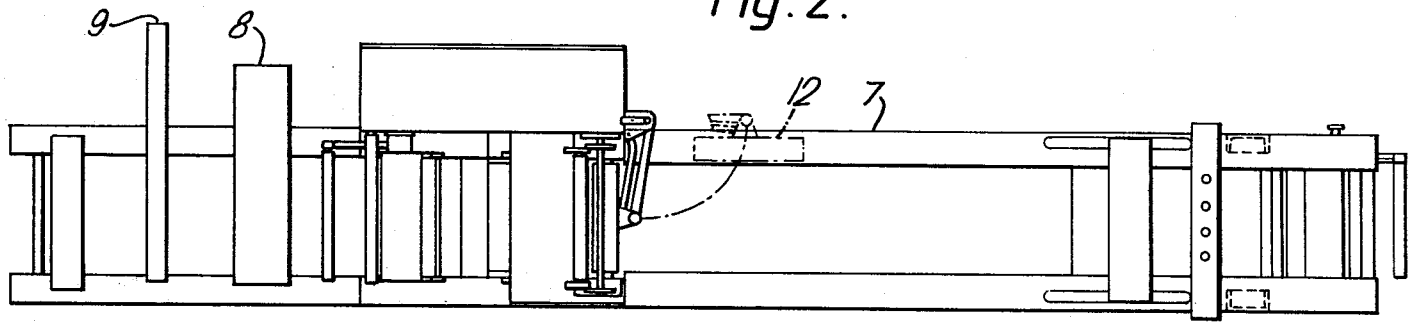
FIG. 2 is a top plan view of the apparatus shown in FIG. 1.
Figure 3:
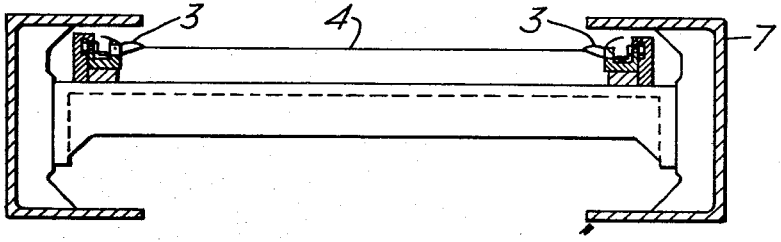
FIG. 3 is a cross-section taken on the line 3—3 of FIG. 1.

The device shown in general form in the side elevational view of FIG. 1 includes a supply roll 1 of flat plastics laminate to be used as the support film in a vacuum pack to be formed by vacuum moulding in a package forming device generally referenced 2. A conveyor system, comprising marginal gripper assemblies 3 shown in the cross-sectional view of FIG. 3, transports the web of support film 4 along a horizontal bed of the apparatus past the easy-open corner-forming device 5 in accordance with the present invention, then past an optional thermoforming device 6 for forming the support film 4 into a tray configuration where because of the nature of the product being such that pre-forming of a receptacle in the support film is necessary in order to avoid undesired movement of the product articles during transport of the support film, the support film 4 is thermoformable and is shaped at the thermoforming device 6 to receive the product articles and to hold them against rotation. From the optional pre-forming device 6, and on its path towards the package forming device 2, the support film 4 may pass through an optional labelling device (not shown) positioned in association with the conveyor bed 7.

After formation of the packages on the web by vacuum moulding, in the package-forming device 2, the packages are then separated from one another by means of a severing device 8, and finally transported laterally from the conveyor bed 7 by means of a lateral transport conveyor 9.

In the package-forming device 2 a layer of upper film material 11 is advanced from a support roll 10, along a downwardly moving run through a pre-heating section comprising radiant heating means built into a door 12 of the package-forming device 2, to be drawn into a concave mould cavity formed in a vertically movable heated moulding platen 13 so that the upper film material 11 is heated, to its softening temperature or higher for thermoforming, while the film is held by suction in contact with the heated wall of the cavity formed in the mould platen 13. Then the application of suction to the underside of the upper film 11 and release of the suction applied to the porous cavity wall of the mould platen 13 draws the upper film downwardly to contact with the support film 4 to thermoform itself over product articles on the support film 4, and to bond to the film 4 upon contact, to form the resulting packages each comprising such a product article (or a group of such product articles where several similar articles are to be arranged into a single pack).

The optional pre-forming station for the support film 4 can, for example, be used where the product articles are sausages, for example frankfurter sausages, which could readily roll about on a flat support film during transportation by the conveyor from the area where they are loaded onto the support film 4 to the package-forming device 2. For example, frankfurter sausages may be packed in batches of five and in that case they will be arranged on the web of support film 4 in groups of five, for example in four groups of five spaced equally across the web, and the package-forming device 2 will seal the periphery of each of these groups of five articles.

Placing of the product articles on the support film 4 may either be performed manually by an operative placing the articles on the travelling web between on the one hand the easy-open corner forming device 5 (or, where the labelling attachment and/or the pre-forming device 6 are fitted, downstream of the last of these two devices) and on the other hand the upstream end of the package-forming device 2.

Alternatively, some automatic loading means may be provided, probably upstream of the easy-open corner-forming device 5, to introduce articles in the correct array on the support film 4, although in this latter arrangement it will be necessary to ensure that the operation of the easy-open corner-forming device 5 does not disturb the arrangement of the product articles on the support film 4.

The perspective view shown in FIG. 4 illustrates the movement of the web of support film 4 (as depicted by arrow 13) and shows also that on this web there are formed several consecutive rows of rectangular panels which will eventually define the support panels of individual packages emerging from the package-forming device 2. The first row of such panels illustrated in FIG. 4 is referenced 14*a*, 14*b*, 14*c* and 14*d*, and the next row is similarly referenced 15*a*, 15*b*, 15*c* and 15*d*. A third such row, generally indicated 16, is disposed in position at the easy-open corner-forming device 5.

The easy-open corner-forming device 5 is carried by a bridge 17 extending transversely across the apparatus and supported at its ends 17*a*, 17*b* on the conveyor bed 7 of the apparatus. A longitudinal adjustment means, in this case a guide slot 18 of the bridge, extend transversely with respect to the direction of advance of the web of support film 4 and serve to locate four separate punching units 19*a*, 19*b*, 19*c* and 19*d*, respectively, at adjustable spacings across the web. Each of these punching units carries a respective blade which forms an L-shaped cut-out coinciding with the corner of the respective panel 14*a*, 14*b*, 14*c* and 14*d* and so on. In short, the blade of punching device 19*a* forms the right-hand leading corner of the consecutive panels 14*a*, 15*a* (and 16*a* etc.) and the same applies to the blades of the other punching units.

Bearing in mind that the support film 4 coming from the supply roll 1 is already wound with a particular curvature, once the L-shaped cut has been formed by the punch, for example the blade of punching unit 19*a*, the action of the punch will tend to displace the film downwardly, in the direction of its natural "curl" so that as the blade then rises during retracting operation of the punching unit, the film will retain its downward displacement and consequently the leading righthand corner of each of the respective panels will be displaced downwardly, and tucked under and held in that position as the support film 4 comes over a floor 20 of the conveyor unit.

The tucking under of each leading righthand corner is then sustained because of the direction of movement of the web material over the floor 20 and consequently, when the pre-heated upper film 11 at the package-forming device 2 is drawn onto that particular panel of the support film 4 under the heated mould platen 13 to bond thereto upon contact, the package will be formed by a seal which extends over the whole of the periphery of the panel (for example panel 14*a*) except at the righthand leading corner where the support film 4 is tucked under.

After the individual packages have been separated from one another at the severing unit 8 and then removed by the lateral feed conveyor 9, the corners are free to return towards their "flat" configuration although, because of the set which will have been adopted in the pressing operation, they will in practice never come back to the fully flat configuration and thus in the finished package (illustrated in FIG. 5) the corner will be readily apparent to the consumer as being the location at which to start opening the package.

As illustrated in FIG. 5, despite the fact that the corner zone 21 of the support material panel in question has been tucked under along a fold line 22, there is nevertheless a part 23 of the seal region between the fold line and the adjacent corner of the product article 24, where the support film is sealed to the superposed panel 25 of the upper film layer 11.

In practice, the support film 4 will be in the form of a laminate having a blend of the required properties of its constituent layers. For example, such a support film laminate may include: (a) an oxygen-barrier layer which may be of an olefin/vinyl alcohol co-polymer, most preferably the hydrolysis product of an ethylene-vinyl acetate co-polymer containing 20–95 mole percent of vinyl acetate units, at least 85 percent of which units have been hydrolysed, the preferred thickness of the barrier layer being 3–30 microns; (b) a substrate layer of unoriented, irradiated polyethylene, oriented polypropylene or oriented polyamide, preferably 10–100 microns thick; and (c) a heat-sealable upper layer of a blend of an ethylene-vinyl acetate co-polymer with a wax, especially paraffin wax, this upper layer having a preferred thickness of 3–15 microns. Such a structure is disclosed in our above-mentioned British Patent Specification No. 1,510,115.

Equally, the upper film 11 may be a laminate. For example, such a laminate may comprise: (a) a substrate first layer, for example of an unoriented polyethylene which may be irradiated or un-irradiated, ionomeric resin, polyester, plasticised vinyl chloride polymer, polyamide or any other thermoformable material with a thickness of 25 to 250 microns; (b) a barrier layer as a second layer, for example a co-polymer of an olefin, preferably ethylene, with vinyl alcohol, with a thickness of from 3 to 30 microns; and (c) a heat-sealable third layer which may for example be any heat-sealable thermoplastics polymer, e.g. polyethylene or an ethylene/vinyl acetate co-polymer, with a thickness of from 5 to 75 microns.

The easy-open corner-forming device 5 shown generally in FIG. 4 and described above in only very general terms, has been found to have a very high success rate in the formation of lasting corner folds (for example at fold line 22), without any other means beyond the curl in the support film 4 holding the tab under as the respective panel (14*a*, 14*b* etc.) moves along the conveyor bed floor 20. However, it may be advantageous to incorporate other means for reinforcing this folding action and these will be described below with reference to the embodiment of FIGS. 6 to 10.

The above-mentioned guide slot 18 serving as adjustment means across the bridge 17 enables the individual punching units 19*a*, 19*b*, 19*c* and 19*d* to be re-arranged, for example by removal of some of the punching units in order to cater for the situation where there may be smaller number of panels, but possibly of larger width, extending across the web of support film 4. Equally, additional punching units beyond the four illustrated in FIG. 4 can be incorporated, and positioned as desired.

As mentioned above additional means may be provided for ensuring retention of the easy-open corner feature; one such system is illustrated in FIG. 6 where the corner tab 21' at the folded zone is held back by means of a tack seal 26. In a manner to be described below, the bent over tab 21' is mechanically thrust under and into contact with the underside of the lower film panel 27 while the spot tack weld 26 is formed for holding the corner permanently back thereby guarding against any tendency, during subsequent handling of the package before or after severing, for the tab 21' to return to its flat configuration on the underside of the upper panel 25'.

Figure 7:
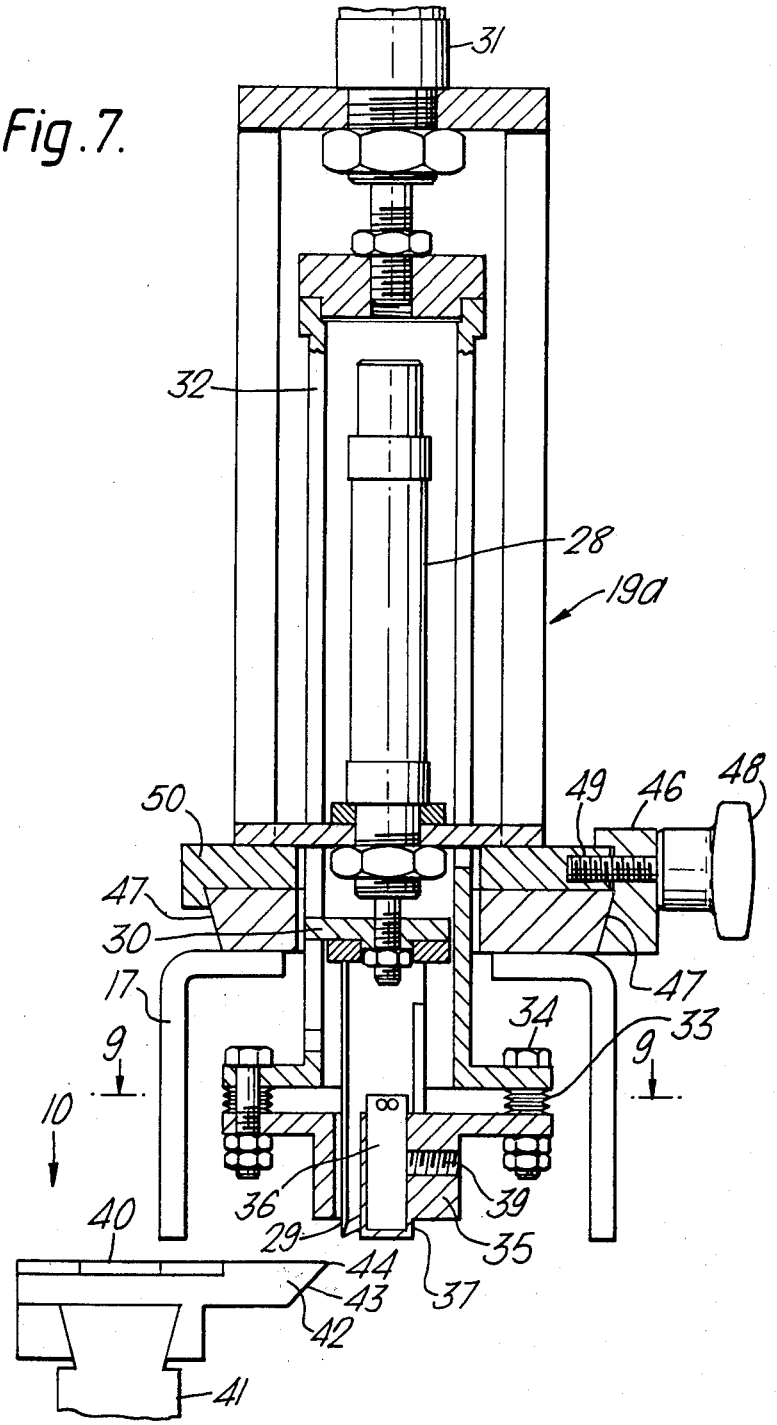
FIG. 7 is a vertical sectional view of the drive assembly for the cutting blade and tack sealing boss of the device for pre-forming an easy-open corner on the pack.
Figure 8:
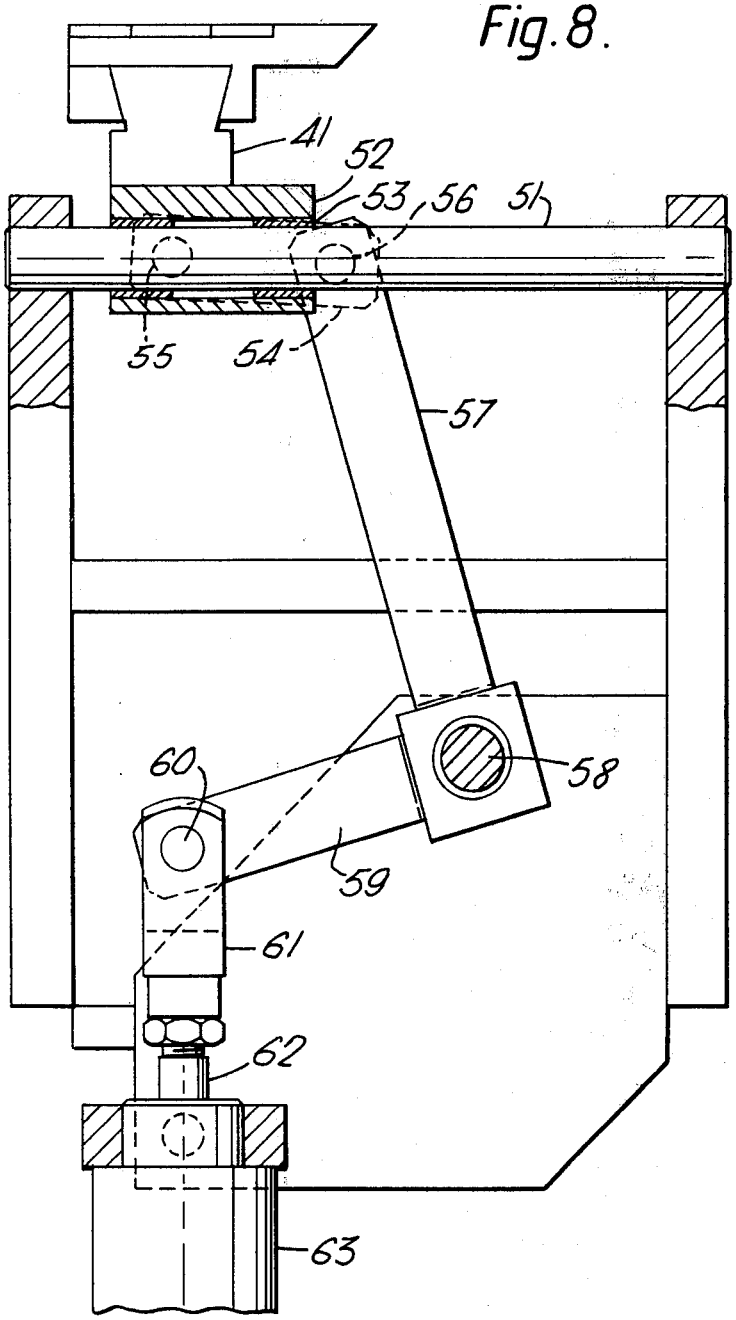
FIG. 8 is a vertical section of the mechanism for driving the tucking anvils of the device for forming the easy-open corner of the pack.
Figure 9:
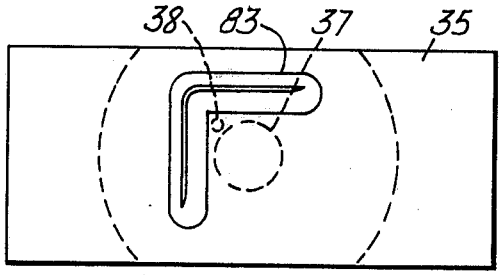
FIG. 9 is a sectional view on the line 9—9 of FIG. 7.

FIGS. 7 and 8 illustrate in detail, as vertical sectional views on a vertical plane parallel to the direction of web transport, the mechanism by which this more permanent form of easy-open corner feature is formed, FIG. 9 illustrates the L-shaped cross-section of the cutting blade and FIG. 10 illustrates the plan view of the anvil 40 and tucking member 42 for forming a tack seal on a tucked under tab of the support film 4.

The modified punching unit 19*a* is illustrated in FIG. 7 as comprising a first ram 28 driving the cutting blade 29 for vertical reciprocation by virtue of the sliding carrier 30 on the end of the piston rod of ram 28. Ram 28 has an air inlet (not shown) above the piston and an air vent (again not shown) below the piston with a spring return action so that once the air pressure above the piston is released, the ram will retract to raise the cutting blade 29. The cutting blade 29 shown in FIG. 7 has the L-shaped cross-section illustrated in FIG. 9, taken on the line 9—9 of FIG. 7.

A second ram 31, operating independently of the knife blade 29 and the first ram 28, drives a yoke 32 for vertical reciprocation. Resiliently mounted, by means of Belleville spring washers 33 and screws 34, at the bottom end of the yoke 32, is a punch member 35 having a heater 36 disposed within a tack seal-forming boss 37 at the lower end of the punch 35. The boss 37 also includes an air orifice 38 (shown in FIG. 9 but not shown in FIG. 7 because it is behind the plane of section) to emit an air jet ensuring downward displacement of the cut tab of the support film 4 during descent of the cutting blade 29 and holding it there during the ascent upon cutting blade retraction. The supply of air to the orifice 38 is by way of the tapped inlet bore 39 via a suitable air line (not shown).

An anvil 40 for the taking seal is defined on a laterally reciprocating assembly 41 having a double-inclined wedge-shaped tucking member 42. The vertical section of FIG. 7 shows that the tucking member 42 has an undercut face 43 to help to deflect the cut tab of the support film 4 downwardly during rightward movement of the assembly 41, but the top plan view of the double-inclined wedge tucking member 42 shows that this member has a diagonally cut top edge 44 further helping to displace the cut tab downwardly. The assembly 41 also carries a guard member 45 (FIG. 10) omitted from FIG. 7.

By virtue of the completely separate operating rams 28 and 31, the descent of the cutting blade 29 and its re-ascent, are quite independent of the descent and re-ascent of the tack sealing boss 37. Equally, the rightward movement of the assembly 41 is actuated by a mechanism, to be described below with reference to FIG. 8, operating quite independently of the ascents and descents of the cutting blade 29 and tack sealing boss 37.

It should be noted that the direction of movement of the web of support film 4 corresponds to leftward movement in FIG. 7, and thus the view of the bridge 17 in FIG. 4 is as if looking along the line of the bridge 17 from the far side of the conveyor as viewed in FIG. 4.

The simplified positioning of the various punching units 19*a*, 19*b*, 19*c* and 19*d* in an elongate slot 18 as shown in FIG. 4 has been achieved by use of modified adjustment means in FIG. 7, by the incorporation of a clamp pad 46 engageable with a dovetail support rail 47. A clamp-operating wheel 48 has an integral threaded shank 49 to join the movable clamp pad 46 to a main clamp body 50, so that the body and pad assembly 50, 46 is slidable along the rail 47 but lockable in place by tightening of the clamp wheel 48. This arrangement permits complete removal of the clamp pad 46 from the clamp body 50, or at least retraction to an extent sufficient to allow the clamp body 50 and the clamp pad 46 to be lifted vertically off the dovetail rail 47 when a particular punching unit (19*a* in FIG. 7) is to be removed from the bridge 17.

The lower end of the punching assembly 19*a* is omitted from FIG. 8 which concentrates on the laterally movable assembly 41 carrying the anvil 40, the tucking member 42, and the actuating mechanism therefor.

As shown in FIG. 8, the assembly 41 includes a further dovetail rail extending across the conveyor and guided on slide bars 51, by means of sliding sockets 52 having friction-reducing bearing bushes 53. The various tucking members 42 and anvils 40 can be attached to, removed from, or adjustably positioned along the dovetail rail just as described above for the punching units 19*a*, 19*b*, 19*c* and 19*d* and make it possible to arrange for each punching unit to be above a respective anvil and tucking member pair 40, 42.

The various slides 52 of the assembly 41 are linked together across the machine and the interconnected assembly of them all has a swinging link 54 articulated thereto at a pivot shaft 55. The free end of the swinging link 54 is itself connected at pivot axis 56 to one arm 57 of a two armed lever having a fulcrum axis 58 and its other arm 59 pivotally connected at pivot shaft 60 to the upper end of a carrier 61 on the piston rod 62 of a ram 63 to actuate the lateral sliding movement of the dovetail rail of the assembly 41.

It is clear that, although not shown in FIG. 8, some lost motion linkage will be provided at the pivot axis 60 so that purely vertical movement of the carrier 61 on the ram piston rod 62 can result in pivoting of the double-armed lever 57, 59 about its fulcrum 58 in order to carry the slides 52 rightwardly and leftwardly along their slide rails 51.

The sequence of operations of the device illustrated in FIG. 7 to 10 is as follows:

Firstly the web of support film 4 is indexed to bring the appropriate panels, for example panels 14*a*, 14*b*, 14*c*, 14*d*, in the correct registration with the respective punching units 19*a*, 19*b*, 19*c* and 19*d*. From now on we shall describe the operation of the single punching unit 19*a* and the common drive assembly 41 for the various anvil assemblies appropriate to the four punching units but it will be understood that on the one hand the punching units all operate in synchronism with one another and on the other hand the drive assembly 41 constrains all the tucking members 42 to operate in synchronism with one another.

The first ram 28 is operated to drive the cutting blade 29 downwardly to form an L-shaped cut in the support film 4. Compressed air is then supplied to inlet 39, resulting in the emission of an air jet through the orifice 38 (FIG. 9) to hold the punched tab of film downwardly as the release of air pressure from above the piston of the first ram 28 results in spring-actuated ascent of the carrier 30 and cutting blade 29.

Then, once the cutting blade 29 is clear of the path of movement of the tucking member 42, the ram 63 is actuated to lift the carrier 61 and thereby to drive all of the anvil tucking member pairs of the drive assembly 41 rightwardly into their positions of registration with the tack seal bosses 37 of the respective punching units 19*a* to 19*d*.

At this stage the upper rams 31 are actuated by application of air pressure above the pistons thereof to drive the yokes 32 and the punches 35 downwardly to bring the respective heated tack seal bosses 37 into contact with the support film 4 and to form a tack seal by compression of the tucked under cut flap of plastics material between the tack seal boss 37 and the anvil 40. For this purpose, the anvil 40 will be formed of a suitable heat-resistant material which is also of a sufficiently non-stick characteristic to allow an adequate tack seal to be formed.

The attachment of the punch 35 to the bottom of the yoke 32 by means of the Belleville spring washers 33 enables the contact pressure between the tack seal boss 37 and the film pressed against the anvil 40 to be limited to a value which will be sufficient to ensure an adequate tack seal.

Finally, the air pressure is released from above the piston of ram 31 to allow the spring-actuated ascent of the yoke 32 and the punch 35 resiliently connected thereto, and once the contact pressure between the tack seal boss 37 and the film has been released, the air pressure on the ram 63 can be released in order to allow spring-actuated descent of the carrier 61 and leftward (i.e. retracting) movement of the assembly 41 comprising the rail with the various anvils thereon. At this stage the web of support film 4 is free of further indexing to recommence the cycle operations.

As shown in FIG. 11*a*, the cutting blade 29 of FIG. 7 has a tip 65 at the apex of the L of the cross-section as shown in FIg. 9, and two cutting edges 66 and 67 inclined upwardly therefrom towards the vertical edges 68 and 69 of the blade. This arrangement has been found to work well in practice and operates in such a way that the tip 65 of the blade first pierces the support film 4 and then the two upwardly inclined cutting edges 66 and 67 slice through that film along perpendicular lines radiating out from the hole pierced by the apex.

FIG. 11*b* shows an alternative construction in which the blade again has an L-shaped cross-section, but where in this case the blade has two tips 70 and 71 and the inclined cutting edges 66′ and 67′ extend upwardly away from the respective tips 70 and 71 towards the apex 65′ of the L. In this case the two tips 70 and 71 first pierce the support film and then the cutting edges 66′ and 67′ slice along perpendicular lines towards the apex of the L of the cut.

The two blades depicted in FIGS. 11*a* and 11*b* are intended for use where one corner of a pack is to be formed by each respective punching unit 19*a*, 19*b*, 19*c* or 19*d*.

On the other hand, FIG. 12 shows an alternative arrangement in which a single cutting blade 29*a* is capable of forming the corner cuts at two adjacent corners (i.e. corners of two adjacent panels). In this case the cutting member is formed with a T cross-section which effectively provides two L-shaped blades (such as 29) positioned back-to-back. There are here three vertical cutting edges 72, 73 and 74 shown in FIG. 13*a* (or 72', 73' and 74' shown in FIG. 13*b*) and the apices of the L-shaped cuts are coincident at 75.

In FIG. 13*a* there is shown the arrangement where such a T cross-section cutting member has three tips, 76, 77 and 78, with the inclined edges extending upwardly from those tips, whereas in FIG. 13*b* there is a single tip 79 having the three inclined edges extending upwardly therefrom towards the vertical edges 72', 73' and 74'. Both of the cutting members shown in FIGS. 13*a* and 13*b* will form the desired T-shaped cut represented by the T-shaped cross-section shown in FIG. 12, but the choice of using one of these cutting members as opposed to the other may depend upon factors such as the nature of the material being cut.

FIGS. 14*a*, 14*b* and 14*c* illustrate the configurations of the various cuts required to form the easy-open corner features of packages where there are four separate packages along each row across the web. It will of course be understood that the same general principles governing the location of the choice of the cutting members used to form the cuts shown in FIGS. 14*a*, 14*b* and 14*c* can be adapted where the number of packs in each row across the web is other than four.

The FIG. 14*a* arrangement in effect shows the top plan view of the configuration of cuts formed in FIG. 4. This requires no further explanation, except to indicate that each of the L-shaped cuts 80 occurs on the leading righthand corner of the web as it moves along the direction of arrow 13.

The arrangement shown in FIG. 14*b* requires only three separate punching units in order to provide the easy-open corner feature of four separate packs corresponding to four panels 15*a*, 15*b*, 15*c* and 15*d* along a row. The cuts in question comprise a first L-shaped cut 80 in the front righthand corner of one marginal panel 15*a*, a second oppositely directed L-shaped cut 81 in the front lefthand corner of the opposite marginal panel 15*d*, and a T-shaped cut 82 at the leading end of the common lateral edge of two adjacent central panels 15*b* and 15*c*. In each case the fold line for the corner tab is illustrated by a broken line.

It will of course be appreciated that, in the case of the punching unit used to form the T-shaped cut 82, the recess in the punch member to receive the T-shaped cutting blades 29*a* will be of a shape different from that of the L-shaped recess 83 shown in FIG. 9. There will of course also be a re-arrangement of the tucking air discharge orifice analogous to orifice 38 shown in FIG. 9.

The advantage of the arrangement shown in FIG. 14*b*, over that shown in FIG. 14*a*, is that none of the cuts 80, 81 and 82 needs to be formed at or near the margin of the web of support film 4. The same advantage is inherent in the configuration shown in FIG. 14*c* where, moreover, only two punching units are required in order to provide the easy-open corner features of four separate packs corresponding to panels 15*a*, 15*b*, 15*c* and 15*d* of a single row.

It will of course be appreciated that any other combination of L-shaped cuts 80 or 81 and T-shaped cuts 82 can be provided depending upon the desired configuration and/or number of panels to be cut. For example, if each row includes five panels, then four of the adjacent panels can be cut by two T-shaped cuts such as cuts 82 shown in FIG. 14*c*, whereas the fifth panel can have its easy-open corner cut by a further punching unit having an L-shaped cutter 29.

Throughout the present application, the shape of the panels used to form the packs has been described as being rectangular and the easy-open feature has been incorporated as a corner zone of the peripheral seal region. However, it will of course be understood that virtually any shape of panel can be provided with the easy-open corner feature of this form, either by providing the easy-open corner at a natural corner of the seal region of the panel, or by providing a triangular projection from the periphery of some non-rectangular or even non-polygonal panel (i.e. as an unadhered zone adjacent the seal region), with the projecting triangular portion tucked under as disclosed in the present application.

Also, it is possible to form the tuck on the upper film instead of or as well as in the support film 4. Similarly, the film being cut and tucked need not be horizontal.

In the above description, it has been indicated that the easy-open corner feature enables the pack to be opened readily by providing an unadhered zone as a starting point for peeling apart the two film layers. It is thus preferable for the seal between two superposed panels to be "peelable". By "peelable seal" we intend to denote a seal in which the adhesion strength is in the range 200 grams/linear inch to 800 grams/linear inch, (i.e. a face seal having an adhesion strength which is within the range likely to be exerted by the typical consumer). It is of course understood that an easy-open corner of the type disclosed in the present application and depicted in FIGS. 5 and 6 is of help even when the seal strength may be greater than that normally associated with a "peelable seal", for example with the delamination action relied upon in the above-mentioned U.S. Pat. No. 3,552,638.

Although the apparatus illustrated in the drawings uses a heat fusion process in order to bond together the upper and lower films to form the package, any other mechanism for joining the two films may be employed. For example, one or both of the films may include a heat-sensitive adhesive, the layers in contact with one another to form the package can be of supercooled polyvinylidene chloride which will self-weld, or (as described above) the films may be of laminates which include weldable layers subjected to the heat and pressure at the package-forming device 2.

Furthermore, throughout the above description reference has been made to a pack which is formed by superposition of two films, such as composite laminates, to enclose discrete product articles therebetween. However, there are various possibilities of other types of pack for which the easy-open corner feature disclosed above can be used. For example, the so-called "Doypack" type of pouch can be sealed with the easy-open corner feature at the "superposed panel top seal" in order to initiate separation of the sealed layers to open the pack.

As a further example of a possible pack with which the easy-open feature of the present invention can be used, we can envisage the application of the easy-open corner to the seal between the rim of a pre-formed thermoformed tray and a closing sealing film.

In any such easy-open pack the displacement of the one film portion (in this illustrated embodiment tucking under of the corner tab of support film 4) will of course occur at a marginal region in order to render access to the unadhered zone easy for the consumer.

I claim:

1. A pack having an easy open feature comprising:

first and second superposed film portions sealed together at a seal region; and wherein a marginal zone of said first film portion at or near said seal region is folded away from said second film portion, back into contact with said first film portion and tacked to said first film portion.

2. A pack according to claim 1, wherein said tack is formed by a heat seal.

3. A pack according to claims 1 or 2, wherein said first and second film portions comprise two separate film sheets.

4. A pack according to claims 1 or 2, wherein said first and second film portions are the walls of a pouch having a mouth region and the mouth region is closable by sealing together said film portions.

5. A pack according to claims 1 or 2, wherein said second film portion comprises a thermoformed tray having a peripheral rim and said first film portion comprises a covering film sealed thereto about said rim and said marginal zone is located at or near said seal.

6. A process for forming an easy-open pack comprising the steps of:

providing first and second at least partially superposed film portions;

making a cut in said first film portion to form a marginal zone at or near a seal region;

displacing said marginal zone of said first film portion away from said second film portion by mechanically folding said marginal zone back to guard against subsequent contact of said marginal zone with said second film portion wherein said mechanical folding comprises an air jet; and sealing said film portions together at said seal region.

7. A process according to claim 6, wherein said first superposed film portion comprises film material having a tendency to curl in a direction and wherein said step of displacing said first film portion comprises displacing said first film portion in the direction of said curl whereby said curl asists in the displacement of said marginal zone.

8. A process according to claim 6, wherein said cut is L-shaped.

9. A process according to claim 6, comprising forming two of said packs in side-by-side relationship with a first corner of a first pack adjacent an associated first corner of a second pack, and said marginal zones of said packs being formed by a T-shaped cut located symmetrically between said first corner and said first associated corner, with a stem of the T disposed on an edge common to the two adjacent corners, and a cross bar of the T disposed on non-common edges of the adjacent corners.

10. A process according to claim 9, wherein a plurality of said packs is simultaneously provided along a row and the displacement of the first film portion at said marginal zones with respect to some of the packs is accomplished by said T-shaped cut and the displacement of the first film portion at said marginal zones of other packs is accomplished by an L-shaped cut.

11. A process according to claim 6, further comprising a step of tacking said marginal zone in the folded back configuration.

12. A process according to claim 11, wherein said tacking is achieved by a tacking heat seal.

13. A process according to claim 6, wherein said pack is formed from first and second superposed multi-function laminate film portions having weldable layers in contact with one another and said weldable layers are prevented from sealing at said marginal zone by said displacement of said marginal zone.

14. A process according to claim 13, wherein said weldable layers are sealed together by bringing them into contact with one another along with the application of weld-activating heat.

15. Apparatus for forming an easy-open pack comprising:

means for supporting a first film portion;

means for displacing a marginal zone of said first film portion at or near a seal area wherein said displacing means comprises an air jet;

means for sealing said first film portion to a second film portion at said seal area; and means for preventing said displaced marginal zone of said first film portion from contacting said second film portion during said sealing.

16. Apparatus for forming an easy-open pack comprising:

means for supporting a first film portion;

means for cutting said first film portion to form a marginal zone;

means for displacing the marginal zone of the first film portion wherein said displacing means comprises an air jet;

means for folding said displaced marginal zone of the first film portion back into contact with said first film portion wherein said folding means comprises tucking means and means for moving said tucking means parallel to said first film portion; and means for sealing said first film portion to a second film portion while said displaced marginal zone of said first film portion is so folded.

17. Apparatus according to claim 16, wherein said cutting means further comprises a cutting blade adapted to move perpendicular to the plane of the first film portion.

18. Apparatus according to claim 17, further comprising first drive means operable to drive said cutting blade; second drive means operable to drive said displacing means and third drive means operable to drive said tucking means; and wherein the first, second and third drive means are adapted to operate so that the cutting means first forms a cut, said displacing means then displaces said marginal zone of the first film portion at the cut, and said tucking means folds said displaced marginal zone of the first film portion back on itself.

19. Apparatus according to claims 15 or 16, wherein said means for supporting said first film portion comprises: means for supporting and advancing a film web defining a plurality of rows of panels each forming a respective first film portion; multiple displacing means each of which is effective to displace a marginal zone of a different panel of a row across said web; multiple tucking means wherein each of said displacing means is associated with a respective tucking means, each of said multiple displacing means being operated in synchronism and each of said multiple tucking means being operating in synchronism.

20. Apparatus according to claim 19, further comprising means for adjusting the position of said displacing means across said film web in order to arrange said displaced marginal zones at different spacings to adjust the sizes of the panels.

21. Apparatus according to claims 15 or 16, further comprising tack sealing means adapted to seal said displaced marginal zone to said first film portion.

22. Apparatus according to claims 15 or 16, further comprising means for heating said second film portion to its softening temperature and then bringing the second film portion into contact, under vacuum, with said first film portion.

23. Apparatus according to claim 22, wherein said means for heating said second film portion includes:

a heated mold cavity; and means for applying a differential pressure onto said second film portion to hold said second film portion in contact with a wall of said heated mold cavity.

24. A process for forming an easy-open pack comprising the steps of:

at least partially superposing a first film portion having a tendency to curl and a second film portion whereby said first film portion has a tendency to curl away from said second film portion;

cutting said first film portion whereby the tendency of said first film portion to curl will cause a displacement of a marginal zone of said first film portion away from contact with said second film portion;

sealing said film portions together at a seal region wherein a portion of seal region is at or near said marginal zone;

continuing said displacement of said marginal zone back into contact with said first film portion; and tacking said marginal zone to said first film portion;

whereby said marginal zone forms an easy-open ear for said pack.

25. The process of claim 24 wherein said tack is accomplished by heat sealing said marginal zone to said first film portion.

* * * * *